US006508018B1

(12) United States Patent
O'Brien

(10) Patent No.: US 6,508,018 B1
(45) Date of Patent: Jan. 21, 2003

(54) SNOW REMOVAL APPARATUS

(76) Inventor: Orlin P. O'Brien, P.O. Box 668, Whitmore Lake, MI (US) 48189-0668

( * ) Notice: Subject to any disclaimer, the term of this patent is extended or adjusted under 35 U.S.C. 154(b) by 0 days.

(21) Appl. No.: 09/738,028

(22) Filed: Dec. 14, 2000

(51) Int. Cl.[7] ..... E01H 4/00
(52) U.S. Cl. ..... 37/223
(58) Field of Search ..... 37/223, 219, 242, 37/244

(56) References Cited

U.S. PATENT DOCUMENTS 1,147,984 A * 7/1915 Spigelman
1,389,727 A 9/1921 Yeiter
2,178,400 A * 10/1939 Marino
2,356,072 A * 8/1944 Mahler
2,751,831 A * 6/1956 Null
2,755,092 A * 7/1956 Donahoe
2,809,389 A * 10/1957 Collins et al.
3,200,519 A * 8/1965 Kennedy
5,553,406 A * 9/1996 Cerny ..... 37/259
6,035,561 A * 3/2000 Paytas et al. ..... 37/246

* cited by examiner

*Primary Examiner*—Christopher J. Novosad
(74) *Attorney, Agent, or Firm*—Alex Rhodes

(57) ABSTRACT

A snow removal apparatus for safely removing snow from irregular surfaces covered with debris such as small stones and gravel. The snow removal apparatus includes at least one roller for spacing a snow removal member of said apparatus a fixed distance above a highest point on a surface below the snow removal member. In a first aspect of the invention, a ground shield and a roller are mounted on a lower portion of a snowblower. In a second aspect of the invention, a ground shield and multiple rollers are mounted on a lower portion of a snowblower which is carried on a small tractor.

11 Claims, 5 Drawing Sheets

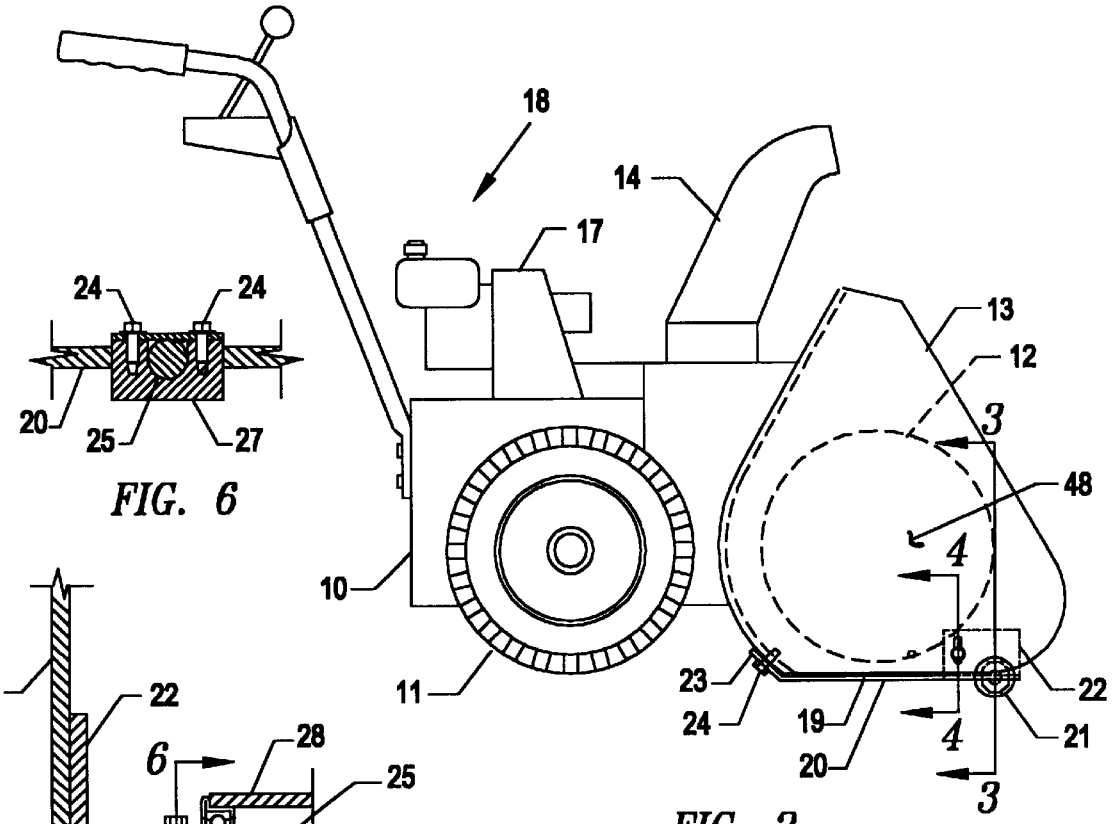
FIG. 2
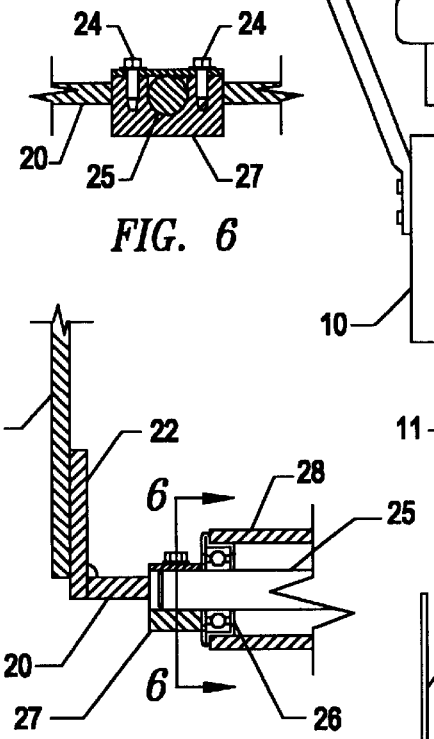
FIG. 6
FIG. 5
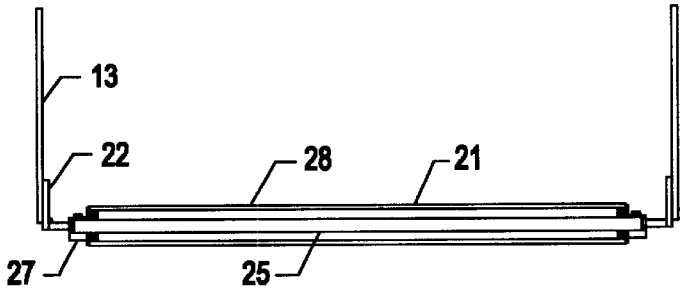
FIG. 3
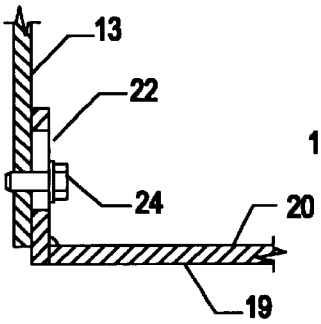
FIG. 7
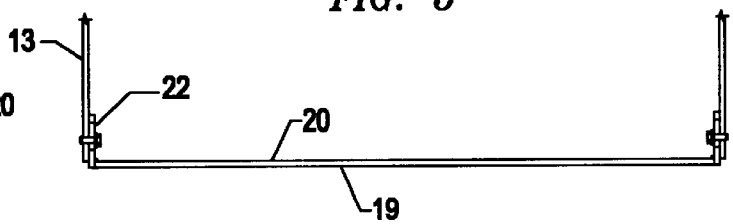
FIG. 4

SNOW REMOVAL APPARATUS

FIELD OF THE INVENTION

This invention relates to the snow removal art and more particularly to snow plows and snowblowers for removing snow from unpaved surfaces, such as driveways, roadways and parking lots.

BACKGROUND OF THE INVENTION

Among the numerous types of snowblowers which exist in the art, none are particularly designed to deal with surfaces covered with loose debris such as gravel driveways and parking lots. When snowblowers with auger wheels are used for clearing snow from unpaved driveways, roads and parking lots, it is not uncommon for the debris such as gravel and stones, to strike and damage the snowblowers or property and injure operators or bystanders. When snowblowers are used for clearing snow from unpaved surfaces, it is rot uncommon for scraper blades and auger wheels to damage a crown or grade by displacing large amounts of small stones and gravel.

These unwelcome effects occur because there is little, if any, protection against debris such as small stones and gravel from striking and entering a snowblower. Skids, shoes and front wheels are provided on some snowblowers to elevate auger wheels above a surface, however, they are relatively ineffective because of surface irregularities such as crowned or washboard surfaces between the skids and front wheels. There are also no provisions in snowblowers for elevating scraper blades and auger wheels above the crowned or washboard surfaces.

SUMMARY OF THE INVENTION

The present invention solves all of the above problems. The invention resides in features which individually and collectively contribute to its ability to elevate snow removal elements at fixed heights relative to highest points over surfaces in the path of snow removal elements. In a first aspect of the invention, a ground shield and a roller are mounted on a hand operated snowblower. In a second aspect of the invention, a ground shield and multiple rollers are mounted on a snowblower which is carried on a small tractor. The ground shields of the snowblowers may be demountable and may have rearward extending angular ramps.

The principal function of the roller(s) is to maintain a snow removal element of a snowblower at a fixed height relative to the highest point on the ground, on a line parallel to the roller. This overcomes a failing of the adjustable shoes on existing snowblowers which result in scraper blades and auger wheels digging into high spots and crests of "crowned" roadways. i.e. crowned in a direction transverse to the direction of travel.

The function of the ground plate are three-fold: (1) it provides a mounting surface for the roller(s); (2) it provides a minimum height of the auger above the roadway on a "washboard" surface, i.e. a surface whose height varies in the direction of travel; and (3) it prevents road debris from striking the auger wheel.

One benefit of the invention is that it requires few, if any, changes to existing auger type snowblowers. A ground plate and roller assembly can be attached to an existing snowblower after removing an existing scraper blade and a pair of shoes, and attaching the "L" brackets in the holes which were used for attaching the scraper blade and shoes. The attachment of the round plate provides additional rigidity to the snowblower.

In employing the teachings of the present invention, a plurality of alternate constructions can be adopted to achieve the desired results and capabilities. In this disclosure, only several aspects of the invention are discussed. However, these aspects are intended as examples and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating specific embodiments of the invention byway of non-limiting example only.

FIG. 2 is a side view of an auger type snowblower according to the present invention.

FIG. 3 is a cross-sectional view taken on the line 3—3 in FIG. 2.

FIG. 4 is a cross-sectional view taken on the line 4—4 in FIG. 2.

FIG. 5 is an enlarged partial view of FIG. 3.

FIG. 6 is a cross-sectional view taken on the line 6—6 in FIG. 5.

FIG. 7 is an enlarged partial view of FIG. 4.

DETAILED DESCRIPTIONS OF A PREFERRED EMBODIMENT

Figure 1:
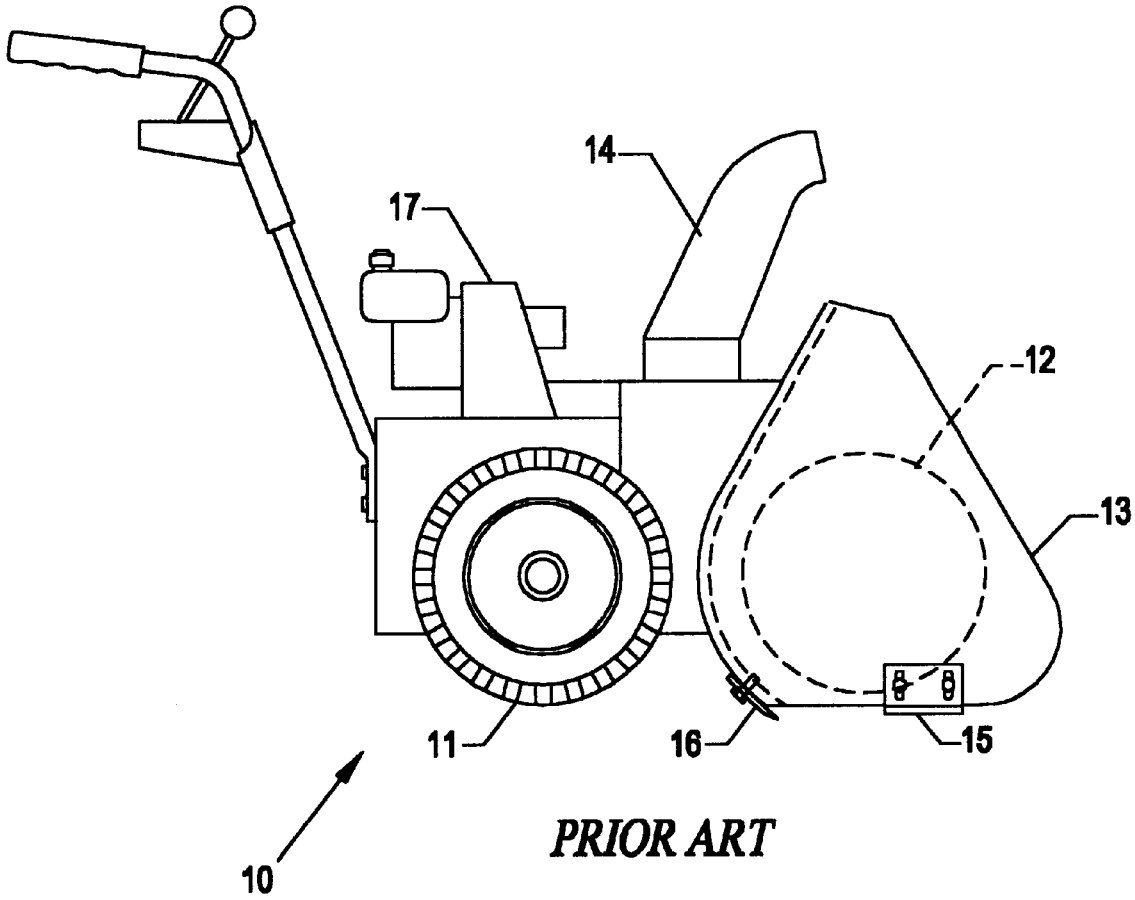
PRIOR ART FIG. 1
FIG. 1 is a side view of a typical auger type snowblower of the prior art.

Referring now to the drawings wherein like numerals designate like and corresponding parts throughout the several views, a small typical auger type snowblower 10 is shown in FIG. 1 which exists in the prior art. The typical snowblower 10 has a pair of wheels 11, an auger wheel 12, a housing 13 which covers the sides and top of the auger wheel 12, an exhaust duct 14, a pair of shoes 15 for spacing the auger wheel 12 above a surface, a scraper blade 16, and an engine 17 for rotating the auger wheel 12. The front and bottom of the housing 13 are open.

As the typical snowblower 10 is traversed across a snow covered surface, snow enters the housing 13, contacts the auger wheel 12, is thrown upward by the auger wheel 12, and is directed away to a side of the snowblower 10 by the exhaust duct 14. A major problem with a prior art snowblower 10 is that it is not uncommon for loose debris, such as small stones and gravel, from damaging the snowblower 10 or injuring an operator or a bystander. This problem is mainly due to the exposure of the auger wheel 12 to loose debris, particularly on surfaces such as gravel driveways and parking lots.

Auger wheel 12 contacts with loose debris can be avoided by tilting the snowblower about the large wheels 11 or resting the front of the snowblower 10 on the ground shoes 15, however, experience shows that these measures are largely ineffective in reducing snowblower damage and injuries to bystanders and operators. Still further, loose debris is difficult to observe because an operator's vision is obscured by an agitation of the snow by the auger wheel 12 of the snowblower 10.

With reference to FIGS. 2 through 6, inclusive, a snowblower 18 is shown according to the present invention. In the improved snowblower 18, a ground shield 19 is attached to the housing 13 of the snowblower 18 for covering the bottom of the auger wheel 12. One advantage of the FIGS. 2 through 6 embodiment 18 is that no snowblower changes are required for attaching the ground shield 19. The ground shield 19 is attached by removing the ground shoes 15 and scraper blade 16 from the housing 13 and attaching the ground shield 19 in the same manner as the shoes 15 and scraper blade 16.

Another benefit of my invention is that it allows the ground shoes 15 and a scraper blade 16 to be re-installed since the ground shield 19 is demountable and its attachment to a snowblower is the same.

The ground shield 19 is comprised of a thin plate 20 which substantially subtends the bottom of the housing 13 and a roller 21 which substantially extends in lateral relationship across the width of the housing 13. The attachments of the ground shield 19 and the roller 21 are best shown in FIGS. 5 and 6. At the front of the ground plate 20 are a pair of upward extending tabs 22 with slotted apertures 28 which are attached with standard fasteners 24 to sides of the housing 13. The rear of the ground plate 20 is an upward extending portion which is attached in the same manner as the scraper blade 16 to the housing 13.

Figure 8:
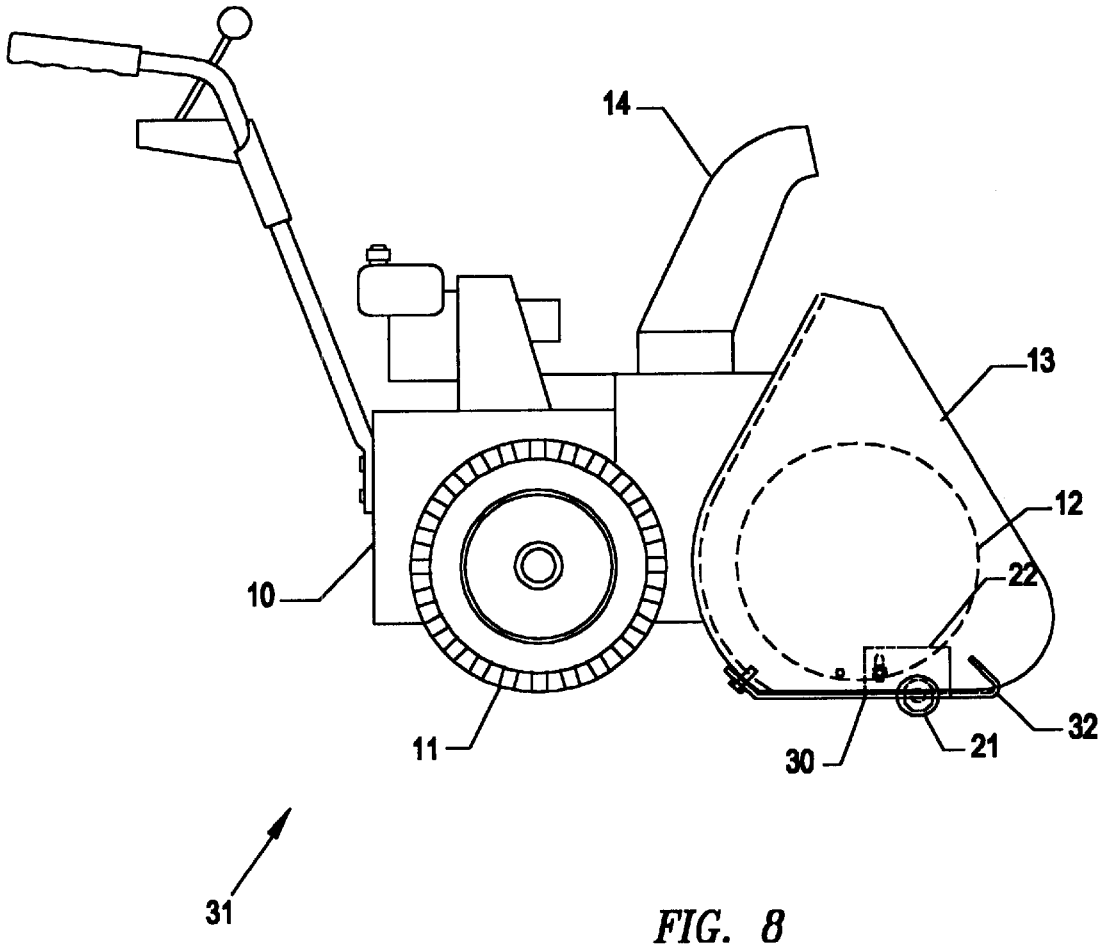
FIG. 8 is a side view of an alternate embodiment.

The roller 21 which is an important feature of my invention 18 is mounted ahead of the center 48 of the auger wheel. It is comprised of a thin slender tube 29, a flanged ball bearing 26 at the ends of the tube 29, and a long slender rod 25. The ends of the rod 25 are retained as shown in FIG. 6 in a pair of end caps 27 which are attached to the ground plate 20. The vertical relationship of the roller 21 with the auger wheel 12 is selectably adjustable by adjusting the position of the ground plate 20 on the housing 13 with the slotted apertures 28. An alternate embodiment 29 is shown in FIG. 8 wherein a forward, upward portion of a ground plate 30 serves as a rearward extending angular ramp 32.

Figure 9:
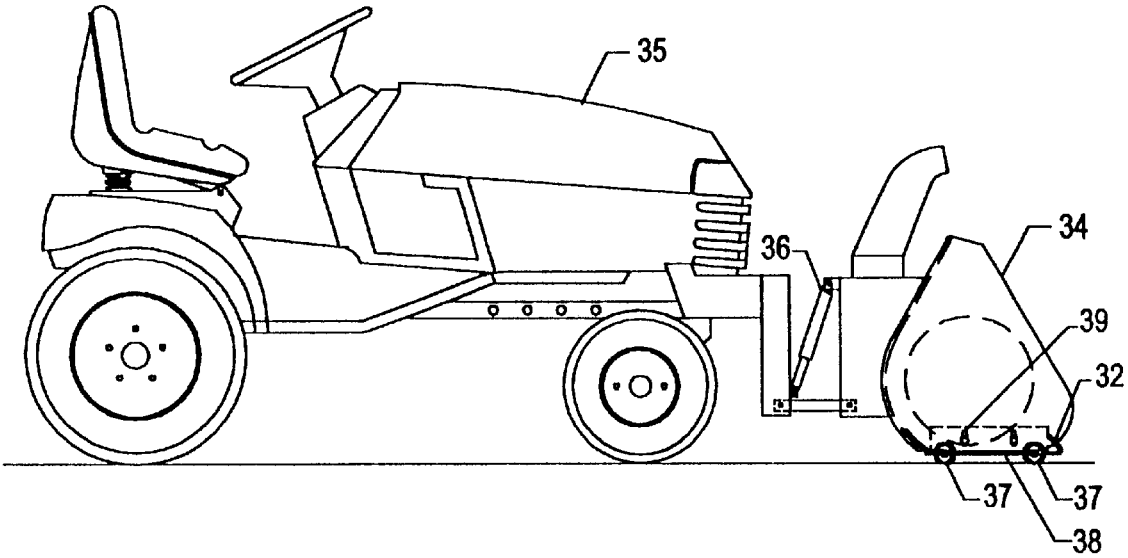
FIG. 9 is a right side view of a small tractor and snowblower according to the present invention.
Figure 10:
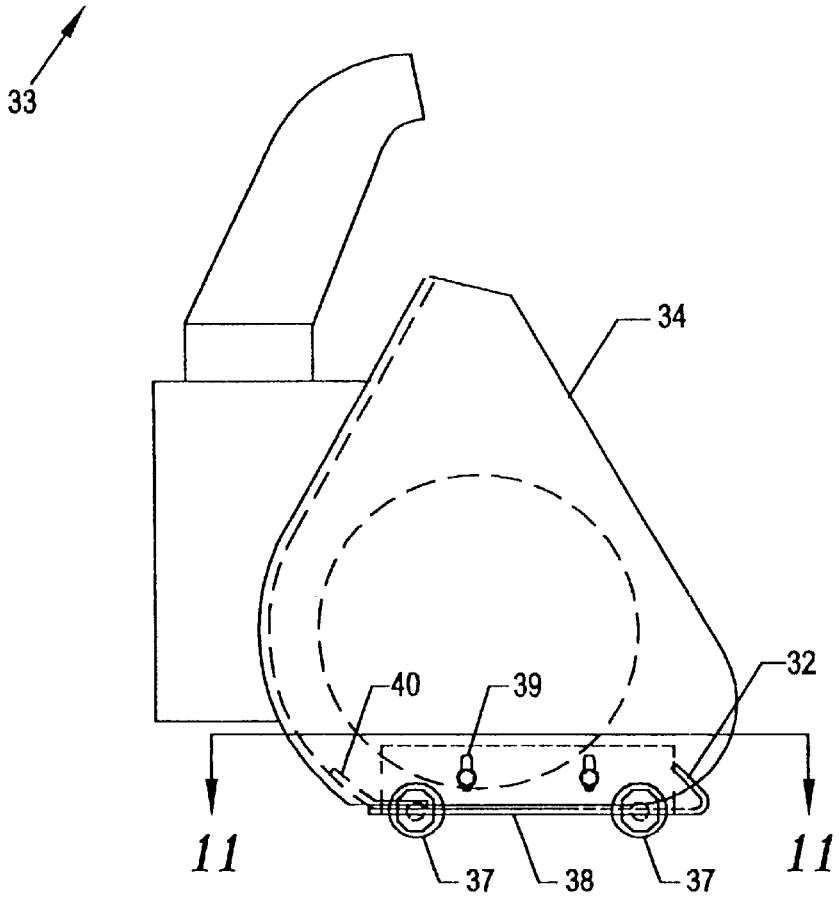
FIG. 10 is an enlarged right side view of the snowblower.
Figure 11:
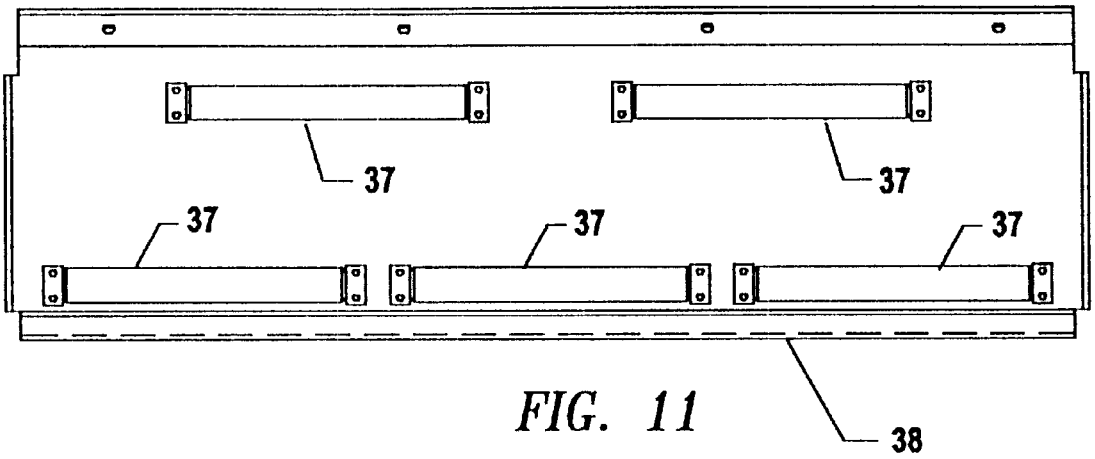
FIG. 11 is a cross-sectional view taken on the line 11—11 in FIG. 10.

In FIGS. 9 through 11, an embodiment 33 of my invention is shown wherein a snowblower 34 is carried on a front end portion of a small tractor 35. The snowblower 34 is raised and lowered by a hydraulic cylinder 36 which connects an upper portion of the snowblower 34 with a lower front portion of the tractor 35. To support the weight of the overhanging snowblower 34, multiple rollers 37 are provided, as shown in FIG. 11. The rollers 37 are mounted on a ground plate 38 which covers the lower portion of the snowblower 34. As an auxiliary enhancement, the adjustable height feature previously described can be modified for the tractor embodiment 33 as follows: A second pair of vertical slots 39 are provided in place of scraper blade holes for attaching the rear portion of the ground plate 38 to the snowblower 34. An optional seal 40 is shown at the rear edge of the ground plate 40 to seal the opening between the ground plate 38 and the snowblower 34.

The invention is used in the following manner. A snowblower is traversed across a snow covered surface with the roller(s) at the front of the snowblower contacting the snow covered surface. Tests of the invention on a gravel driveway have shown that the invention substantially reduces the amount of gravel, small stones and other debris which contact a snowblower auger wheel.

From the foregoing it will be appreciated that my invention is a substantial improvement for reducing damage to snowblowers, snow plows, unpaved surfaces and injuries to bystanders and operators. Moreover, the benefits of my invention are immediately available because snowblowers and snow plows can be retrofitted with few, if any, changes.

What I claim is new is:

1. In combination with a snow removal apparatus having a rotating auger wheel for gathering snow from a ground surface and a housing for covering a top, rear and sides of said auger wheel, at least one laterally positioned roller, said roller being mounted for rotation ahead of a center of said auger wheel and extending in parallel relationship across a length of said auger wheel for raising said auger wheel above a ground surface and debris on said ground surface along a path of said snow removal apparatus, a ground shield below said auger wheel, said ground shield comprised of a plate for preventing said debris from striking said auger wheel and damaging property, operators, bystanders and said snow removal apparatus by enclosing an open lower portion of said housing, said ground shield being in bordering relationship with said ground surface except for sufficient clearance to clear said ground surface and said debris, and a means for attaching said ground plate to said housing.

2. The combination recited in claim 1 further comprising a means for vertically selectively adjusting a position of said ground plate on said housing.

3. The combination recited in claim 1 wherein said means for detachably mounting said ground shield comprises a plurality of fasteners in threaded engagement with existing apertures of said auger housing.

4. In a snow removal apparatus having an auger wheel for gathering snow from a ground surface, a housing for surrounding a pair of sides, rear and a top of said auger wheel, and at least one laterally positioned roller mounted in front of said auger wheel for rotation, said roller extending across a length of said auger wheel for raising said auger wheel above a ground surface and debris on said ground surface along a path of travel of said snow removal apparatus, the improvement comprising: a means for preventing said debris from striking said auger wheel and damaging property, operators, bystanders and said snow removal apparatus, said means comprising a ground shield for covering an open lower portion of said housing, said ground shield being in bordering relationship with said ground surface except for sufficient clearance to clear said ground surface and said debris; and a means for mounting said ground plate on said housing.

5. The improvement recited in claim 4, wherein said ground shield is detachably mounted to said housing.

6. In a snow removal apparatus, the improvement comprising; a means for preventing damage to property, operators, bystanders and said snow removal apparatus from debris on a ground surface striking a rotating snow removal member of said apparatus, said means comprising: at least one laterally positioned roller ahead of a center of said rotating member for raising said rotating member above said ground surface and debris on said ground surface and a ground plate below said rotating member in bordering relationship to said ground surface except for sufficient clearance to clear said ground surface and said debris; and a means for selectively adjusting said clearance with said ground surface.

7. The improvement recited in claim 6 wherein said snow removal apparatus is a snow plow blower.

8. The improvement recited in claim 6 wherein said snow removal apparatus is a snow plow.

9. The improvement recited in claim 6 wherein said apparatus has multiple rollers.

10. A method for improving the safety of a snow removal apparatus having an auger wheel, a housing for covering a pair of sides and a top of said auger wheel, a pair of shoes mounted on opposite sides of said housing and a scraper blade mounted at a rear of said housing, comprising the steps of removing said pair of shoes from the sides of said housing, removing said scraper blade from said rear of said housing; and substantially covering an open lower portion of said housing of said snow removal apparatus with a ground plate in bordering relationship with a ground surface except for a clearance to said ground surface which is sufficient to clear said ground surface and debris on said ground surface.

11. The method recited in claim 10 further comprising the step of adjusting said clearance of said ground plate to said ground surface.

* * * * *

UNITED STATES PATENT AND TRADEMARK OFFICE

CERTIFICATE OF CORRECTION

PATENT NO. : 6,508,018 B1
DATED : January 21, 2003
INVENTOR(S) : Orlin P. O'Brien It is certified that error appears in the above-identified patent and that said Letters Patent is hereby corrected as shown below:

Column 1,
Line 20, change "rot" to -- not --

Column 3,
Line 2, after "snowblower" insert -- 10 --

Column 5,
Line 2, after "snow" delete "plow"

Signed and Sealed this

Twenty-fifth Day of March, 2003

JAMES E. ROGAN
*Director of the United States Patent and Trademark Office*